United States Patent [19]

Cairncross et al.

[11] Patent Number: 4,913,998

[45] Date of Patent: Apr. 3, 1990

[54] SILVER-BASED ELECTROSTATIC PRINTING MASTER

[75] Inventors: Allan Cairncross, Hockessin; Catherine T. Chang, Wilmington, both of Del.

[73] Assignee: E. I. Du Pont de Nemours and Company, Wilmington, Del.

[21] Appl. No.: 267,407

[22] Filed: Dec. 30, 1988

Related U.S. Application Data

[63] Continuation-in-part of Ser. No. 196,803, May 16, 1988, Pat. No. 4,868,081, which is a continuation-in-part of Ser. No. 859,114, May 2, 1986, abandoned.

[51] Int. Cl.[4] ..... G03G 5/026; G03C 1/30; G03C 1/94

[52] U.S. Cl. ..... 430/96; 430/311; 430/524; 430/624; 430/625; 430/627; 430/628

[58] Field of Search ..... 430/49, 96, 627, 628, 430/311, 524, 624, 625, 536; 101/DIG. 15

[56] References Cited

U.S. PATENT DOCUMENTS

| | | | |
|---|---|---|---|
| 3,540,886 | 11/1970 | Ansel et al. | 96/1.8 |
| 3,681,069 | 8/1972 | McNamee, Jr. et al. | 96/1.5 |
| 4,057,016 | 11/1977 | Endo et al. | 101/465 |
| 4,069,759 | 1/1978 | Endo et al. | 101/467 |
| 4,105,448 | 8/1978 | Miyatuka et al. | 96/1.8 |
| 4,167,602 | 9/1979 | Serlin | 428/240 |
| 4,268,595 | 5/1981 | Katagiri et al. | 430/48 |
| 4,281,052 | 7/1981 | Ito et al. | 430/48 |
| 4,427,754 | 1/1984 | Uchida et al. | 430/60 |
| 4,428,754 | 1/1984 | Uchida et al. | 430/60 |
| 4,510,238 | 4/1985 | Kingston et al. | 430/627 |
| 4,517,271 | 5/1985 | Hirooka et al. | 430/94 |

FOREIGN PATENT DOCUMENTS

57/185440 11/1982 Japan .

*Primary Examiner*—Richard L. Schilling

[57] ABSTRACT

Compositions and films are provided for the preparation of electrostatic printing masters. The composition binder permits use of aqueous silver halide photographic techniques to image the master for printing, and exhibits insulation properties needed for electrostatic printing under typical conditions of relative humidity.

39 Claims, 4 Drawing Sheets

SILVER-BASED ELECTROSTATIC PRINTING MASTER

RELATED APPLICATIONS

This application is a continuation-in-part of application Ser. No. 196,803 filed May 16, 1988, now U.S. Pat. No. 4,868,081 which in turn is a continuation of application Ser. No. 859,114 filed May 2, 1986, now abandoned.

BACKGROUND OF THE INVENTION

This invention relates to electrostatic printing and, more particularly, to an improved electrostatic printing master adapted for the use of conventional silver halide photographic techniques during preparation of the master for printing.

Electrostatic printing is well-known in the art and has been proposed as an alternative to other printing techniques. In one method of electrostatic printing, one first prepares a "master" that is capable of selectively holding electrostatic charges to form the desired image. The master is exposed to a corona discharge that forms a latent electrostatic image, and contacted with dry or liquid toner of the opposite electrostatic charge to develop the image. The toned image is then transferred to a substrate, typically paper, where the toner is fused to fix the image, and the master is returned for the next printing cycle.

It has been suggested in U.S. Pat. No. 4,069,759 that an improved electrostatic printing master can be fabricated by dispersing a conventional silver halide photographic salt in an insulating polymer (e.g., gelatin), and coating the dispersion on a conducting substrate. The coating is exposed imagewise, and is developed to cause the exposed silver halide to be reduced to metallic silver. The unexposed silver halide is then dissolved and removed from the coating to fix the image. While the master suggested in U.S. Pat. No. 4,069,759 offers many advantages, and permits the use of conventional aqueous silver halide photographic chemistry when gelatin is selected as the insulating polymer, it has been found that gelatin is too highly sensitive to humidity to have practical application in a typical workplace. Gelatin rapidly absorbs mositure from the air and at moderate to high humidities no longer functions as an insulating medium, but provides a conductive path that grounds surfaces charges imposed on the master during the electrostatic printing process.

Thus, there is a need for an improved electrostatic printing master that will offer the advantages of being based on conventional aqueous silver halide photographic chemistry and provide superior insulating properties under relative humidity conditions commonly encountered during printing.

SUMMARY OF THE INVENTION

This invention provides a photosensitive composition adapted for use in preparing an electrostatic printing master, the composition consisting essentially of a silver halide photographic salt dispersed in an insulating polymeric binder that is swellable in aqueous photographic processing solutions having a pH higher than approximately 8½, and retains significant insulating properties under relative humidity conditions normally encountered during the printing process. The composition has an insulation value such that it will support an apparent macroscopic electric field of at least five (5) volts/micron, as measured by an electrostatic surface voltage probe two (2) seconds following full charging of its surface that has been allowed to equilibrate at 50% relative humidity at 20° C. for an hour. Common photographic gelatin, practically the only medium conventionally used for wet processing, holds approximately one (1) volt/micron or less after equilibration under these test conditions. Since the binder is swellable under pH conditions higher than approximately 8½, conventional aqueous silver halide developing solutions can be used to process the master for use in electrostatic printing. Copolymers of acrylic or methacrylic acid having acid numbers in the range of 70 to 160 are a preferred binder that may be selected in practicing the invention. The silver halide/binder composition is typically coated onto a conducting substrate, which may be mounted on a flexible support, for use as an electrostatic master. After the master is imaged with actinic light, the master is developed to contain a silver image using conventional aqueous silver halide developing and fixing chemistry.

In a second embodiment, a diffusion transfer film is prepared by coating the polymeric binder which contains development nuclei onto a conductive support, and overcoating the binder with a conventional silver halide photographic emulsion. The photosensitive element is exposed and then developed using conventional diffusion transfer techniques to provide an imaged electrostatic master.

It now has been found that polyfunctional epoxide and aziridine crosslinking agents unexpectedly improve optical density, $D_{max}$, of the conducting silver image contained in the developed electrostatic master, improving its utility as a phototool.

As used herein, the term "electrostatic master" refers to the film element that will be used for electrostatic printing, whether the film element contains silver particles in the form of the desired image, and thus is ready for the printing process, or contains silver halide particles that yet have to be exposed and/or developed.

DETAILED DESCRIPTION OF THE INVENTION

Figure 1:
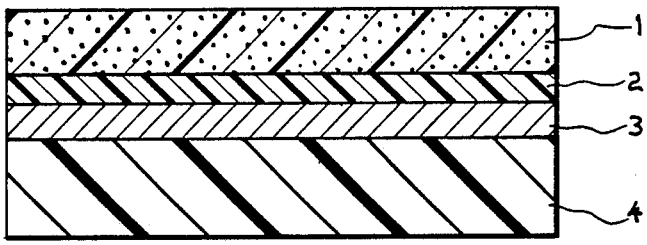
FIG. 1 is a schematic sectional view of an electrostatic printing master in which a silver halide photographic salt is dispersed in the insulating binder to form photosensitive layer 1.

The use of conventional aqueous silver halide photographic chemistry ideally serves the requirements for the preparation of electrostatic printing masters, particularly when high resolution is required for high-quality half-tone or continuous-tone applications. Sharp image resolution can be obtained due to the fine grain size of silver that may be obtained when using aqueous photographic chemistry well known in the art.

Insulating binders that may be selected in practicing the invention are "swellable" in aqueous solutions having a pH higher than approximately 8½, typically in the range of 9 to 14, that are common to conventional aqueous developing solutions used in silver halide photography. By "swellable" it is meant that the binder readily takes up water, and indeed swells in this pH range similar to gelatin. When using preferred polymers described hereinafter, swelling is accomplished by ionizing acidic groups (usually carboxylic acid groups that are chemically bonded to the insulating binder) by basic solutions at a pH of approximately 8.5 or higher. This characteristic permits the aqueous developer (reducing) solution to come into intimate contact with the silver halide. When negative working silver halide emulsions are used, the exposed silver halide is reduced by developer solutions to metallic silver and complexing agents dissolve the unexposed silver halide salt. When positive working silver halide emulsions are used (e.g. those prepared by such well-known techniques as solarization or chemical fogging) the unexposed silver halide is reduced to metallic silver and the exposed silver halide is removed.

In the embodiment described in greater detail hereinafter in which negative working silver halide is dispersed in the insulating binders provided by the invention, developer above approximately pH 8.5 swells the binder and reduces exposed silver halide to metallic silver and complexing agents, usually in a fixer solution, remove unexposed silver halide. In the diffusion transfer embodiment where negative working photosensitive silver halide is in an emulsion layer (usually gelatin) that is separate from the insulating binder containing a fine dispersion of development nuclei, developer solution having a pH above approximately 8.5 swells both the emulsion layer and insulating binder layer provided by this invention, thereby developing the exposed silver halide to metallic silver in the emulsion layer and dissolving the unexposed silver halide with complexing agents ("silver solvents"). The complexed unexposed silver halide then diffuses into the swollen binder layer wherein the silver ions are selectively reduced to silver metal on the development nuclei.

Although the insulating binders are swellable in the developing solution, the insulating properties do not drastically deteriorate as those of gelatin do under typical humidity conditions encountered in the workplace. As a consequence, the binders will retain an applied charge during electrostatic printing and it is not necessary to provide special humidity controls or dry the master before each printing cycle, as would be necessary using a gelatin binder.

The binders generally are characterized as being capable of supporting an apparent macroscopic electric field of at least 5 volts per micron, and preferably at least 30 volts per micron, as measured by an electrostatic surface voltage probe two (2) seconds following full charging of the surface after the surface has been allowed to equilibrate, and thus absorb moisture, at 50% relative humidity and 20° C. Equilibration for testing purposes will normally occur within approximately 60 minutes. In contrast, gelatin is significantly inferior and exhibits an apparent macroscopic electric field in the order of approximately one (1) volt per micron or less under this test procedure.

It has been found that synthetic polymers having an acid number of approximately 70 to 160 are particularly useful in practicing the invention. A preferred class of polymers contains 10 to 25% by weight of acrylic or methacrylic acid to impart swellability. The polymer typically will also contain styrene, or other aromatic monomers, that are not compatible with water, and thus render the polymer less hydrophilic to moisture in the air. Generally, the polymer will also contain monomers, such as appropriate acrylic or methacrylic esters, that contribute to film clarity, flexibility, toughness, processibility, etc. Other comonomers, such as alkenes having 2 to 12 carbon atoms, haloolefins, vinyl acetate, vinyl ethers having 3 to 12 carbon atoms, methacrylamide, and the like can be similarly useful.

Preferred polymers are copolymers containing styrene and acrylic or methacrylic acid monomers, and preferably also an acrylic or methacrylic ester monomer. Polymers containing 25 to 35% by weight styrene, 10 to 25% by weight acrylic or methacrylic acid, with the remainder comprising acrylic or methacrylic esters, are particularly preferred. The molecular weight of the preferred copolymers will typically be in the range of 25,000 to 150,000. These polymers are compatible with silver halide dispersions, will form reasonably durable films that have clarity, and are readily available from commercial sources, or can be made using conventional techniques such as free radical polymerization in suspension or emulsion. Equivalent polymers that will be useful in practicing the invention will be readily apparent to those skilled in the art. These polymers include acrylic acid and methacrylic acid polymers and copolymers, and include commercially available polymers such as Carboset® 525 and Carboset® 526 manufactured by B. F. Goodrich Company, and Joncryl® 67 manufactured by Johnson & Johnson.

A preferred class of polymers constitutes terpolymers and tetrapolymers of (1) a styrene-type monomer, (2) an acrylate-type monomer, and (3) an unsaturated carboxyl-containing monomer. The first component lends hardness and moisture resistance to the polymer; the second, flexibility and plasticity to the polymer backbone; and the third, alkali-swellability. The styrene-type monomer will typically be styrene, an alpha-substituted styrene having a 1 to 6 carbon alkyl group, and those wherein the benzene ring has functional substituted groups such as nitro, alkoxy, acyl, carboxy, sulpho, or halo, with simple compounds such as styrene, alphamethyl styrene, para-methyl styrene and para-t-butyl styrene being preferred. The acrylate-type component includes alkyl and hydroxyalkyl acrylates and methacrylates wherein the alkyl group has from 1 to 12, preferably from 1 to 6 carbon atoms such as methyl methacrylate, ethylmethacrylate, ethyl acrylate, hydroxypropyl methacrylate, hydroxyethyl methacrylate and hydroxyethyl acrylate, and mixtures thereof. The unsaturated carboxyl-containing monomer will typically be a monomer having from 3 to 15 carbon atoms, preferably 3 to 6, and includes cinnamic acid, crotonic acid, sorbic acid, itaconic acid, maleic acid, fumaric acid, or more preferably acrylic or methacrylic acid, their corresponding half ester or the corresponding anhydride.

When this class of polymer is selected in practicing the invention, the ratio of the three monomer components is selected such that the conductive film element has the following properties: the silver halide, when incorporated into the conductive film element, is processible by conventional aqueous photographic techniques; the electrostatic master made therefrom retains applied charges in the nonsilver areas under ambient relative humidity conditions; and the electrostatic master is flexible and durable, but not tacky. Typical proportions used to achieve these results are shown in Table 1:

TABLE 1

| Binder Component | Broad Range (weight %) | Preferred Range (weight %) |
|---|---|---|
| Styrene-type | 10–50 | 25–35 |
| Acrylate-type | 0–85 | 40–65 |
| Carboxylic acid-type | 5–50 | 10–25 |

Polymers within this class also generally offer the advantage of being insensitive to Isopar ®, the commonly used carrier employed in liquid toning systems.

Insulating polymeric binders described above are made by conventional free-radical polymerization techniques, as illustrated in the examples. These polymers are soluble in basic solutions and can be coated from aqueous solutions of triethylamine, ammonia, or potassium hydroxide, and the like. These polymers are compatible with silver halide dispersions and will form reasonably durable films that have clarity. It may be desired to modify the binder (crosslink, harden, plasticize, adjust acidity, etc.) prior to aqueous photographic processing, and thereby control swelling or improve durability. Various modifying agents may be added for these purposes. Typical modifying agents include aldehydes, multifunctional aziridines, and epoxides. The diglycidyl ether of 1,4-butanediol is a preferred modifying agent for this class of polymers in practicing the invention.

In accordance with one aspect of the present invention, it has been found that use of polyfunctional epoxide or aziridine crosslinking agents with the above described copolymers of an aromatic monomer and a carboxylic acid, when used in quantities of approximately 1 to 30% by weight (based on the copolymer weight), preferably 2 to 12% by weight, will unexpectedly improve optical density ($D_{max}$) of the conducting silver image contained in the developed electrostatic master, in addition to usually improving adhesion, durability, and processibility of the copolymer. When the crosslinking agent is used, it is conveniently added to the binder solution, which is then coated and air dried. The coated composition may be heated to expedite crosslinking, if so desired.

A variety of polyfunctional epoxide and aziridine crosslinking agents are known in the art. See, for example, *Handbook of Epoxy Resins*, H. Lee and K. Neville, McGraw Hill, N.Y., 1967; *Encyclopedia of Chemical Technology*, 3d. Ed., Wiley-Interscience, N.Y., 1980, Vol. 9, *Epoxy Resin Chemistry*, I and II, ACS Symposium Series Nos. 114 and 221, American Chemical Society, Washington, DC, 1979 & 1983. These crosslinking agents may contain aliphatic, cycloaliphatic, aromatic or heterocyclic backbones derived from polyols or low molecular weight condensation polymers. Representative polyfunctional epoxides include: butadiene dioxide; dimethylpentane dioxide; diglycidyl ether; vinylcyclohexene dioxide; limonene dioxide; bis-(2,3-epoxycyclopentyl)ether; divinyl benzene dioxide; 1,4-butanediol diglycidyl ether; trimethylolpropane triglycidyl ether; ethoxylated trimethylolpropane triglycidyl ether; neopentyl glycol diglycidyl ether; cyclohexanedimethanol diglycidyl ether; glycerine triglycidyl ether; 3,4-epoxy-6-methylcyclohexane carboxylate; the diglycidyl ether of resorcinol; the diglycidyl ethers of bis-phenol F and bis-phenol A; epoxy phenol novolac resins; methylene dianiline derived epoxy resins; p-aminophenol derived epoxy resins; triazine based epoxy resins; and hydantoin epoxy resins. Preferred are: 1,4-butanediol diglycidyl ether; ethoxylated trimethylolpropane triglycidyl ether; (3,4-epoxycyclohexyl) methyl 3,4-epoxy-cyclohexane carboxylate; diglycidyl ethers of bis-phenol F and bis-phenol A; methylene dianiline derived epoxy resins; p-aminophenol derived epoxy resins; and triazine based epoxy resins. Representative polyfunctional aziridines include: pentaerythritol tri-beta-azirindinylpropionate; N,N'-hexamethylene-1,6-bis(1-aziridinecarboxyamide); and N,N'-diphenylmethane-4,4'-bis(1-aziridinecarboxyamide).

The light sensitive silver halide selected for dispersion in the binder can be any of the well-known salts used in photographic applications. Representative useful salts include silver chloride, silver bromide, silver iodide, silver chlorobromide, silver iodobromide, and silver chloroiodobromide, either singly or in mixtures. Precipitation of the halide is carried out in conventional manner in gelatin. The amount of gelatin present should be limited, or subsequently reduced by rinsing, to avoid defeating purposes of the invention. Generally, levels of gelatin as high as 3 to 15 grams per mole of silver can be tolerated in the electrostatic printing masters, without adverse effect.

Grain size distribution and sensitization of the silver halide can be controlled to adapt the silver halides for the selected class of photographic process, including general continuous tone, X-ray, lithographic, microphotographic, direct positive, and the like. Ordinarily, the silver salt dispersions will be sensitized with conventional compounds such as sulfur, gold, rhodium, selenium and the like, or with organic sensitizing dyes such as cyanine, 1,1'-diethyl-4,4'-cyanine iodide, methine and polymethine cyanine dyes, kryptocyanines, merocyanines, and the like. Other additives commonly employed in silver halide photographic compositions, may also be present if desired.

To prepare the dispersion of silver halide in the insulating polymeric binder, the binder is conveniently first dissolved in an aqueous solution containing amines, such as ammonia or triethyl amine. If desired, an alcohol, such as methanol, ethanol, or isopropanol, may be added to aid in solubilizing the polymer. Ketones, such as methyl ethyl ketone, may be used as a cosolvent. An aqueous dispersion of the silver halide salt is then added to the dissolved binder in the desired quantities. The respective portions of silver halide to binder will depend on details of the application, but will generally be such that surface of the master immediately above the developed silver will discharge significantly faster than areas devoid of silver. Weight ratios of silver to polymeric binder in the range of 0.5:1 to 3:1 will typically provide useful results. A preferred range is 1.7:1 to 2.3:1.

The polymeric binder containing the silver halide is usually applied to a conductive substrate as a solution or dispersion in a carrier solvent, usually an aqueous solution containing basic amines or sodium or potassium hydroxide as described above. The coating procedure may be any conventional one including spraying, brushing, applying by a roller or an immersion coater, flowing over the surface, picking up by immersion, spin coating, air-knife coating, wire-bar coating or any other suitable means. The film thickness can be adjusted accordingly and after drying is usually about 0.02 to about 0.3 mils (0.5–7.5 microns), preferably about 0.04 to about 0.20 mils (1.0–5.0 microns). Depending on the application, the conductive support may be a metal plate, such as aluminum, copper, zinc, silver or the like; a conductive polymeric film; a support such as paper, glass, synthetic resin and the like which has been coated with a metal, metal oxide, or metal halide by vapor deposition or chemical deposition; a support which has been coated with a conductive polymer; or a support which has been coated with a polymeric binder containing a metal, metal oxide, metal halide, conductive polymer, carbon, or other conductive fillers.

In addition to components described above, various conventional photographic additives, e.g., developing agents, super additives, antifoggants, coating aids such as saponin, alkylarylsulfonic acids or sulfoalkylsuccinic acids; plasticizers such as glycerol or 1,5-pentanediol; antistatic agents; agents to prevent the formation of spots; antihalation dyes; underlayers, subbing or backing layers; and the like may be added to the master as appropriate. Positive images may be obtained by reversal processing of the silver halide using either light fogging or a chemical fogging agent; or by using silver halide emulsions that give direct positive images using the prefogging technique. Direct positive emulsions have been described in Leersmaker U.S. Pat. No. 2,184,013, Illingsworth U.S. Pat. No. 3,501,307 and elsewhere.

Referring now to the drawings, FIG. 1 depicts an electrostatic printing master in which photosensitive layer 1 contains sensitized silver halide dispersed in the insulating polymeric binder in accordance with the invention. Layer 1 is generally between 0.5 and 7.5 microns in thickness, but the thickness can be decreased or increased for the specific intended application. A thin layer 2 of an adhesion promoter such as gelatin, which is optional, aids adherence of the photosensitive layer to the conducting substrate 3, which in turn is mounted on supporting substrate 4.

Figure 2:
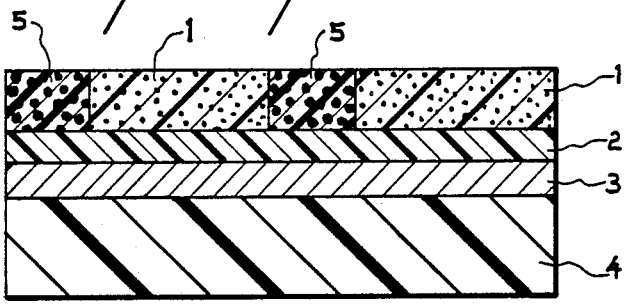
FIG. 2 shows the master of FIG. 1 in which a latent image has been formed and developed.
Figure 3:
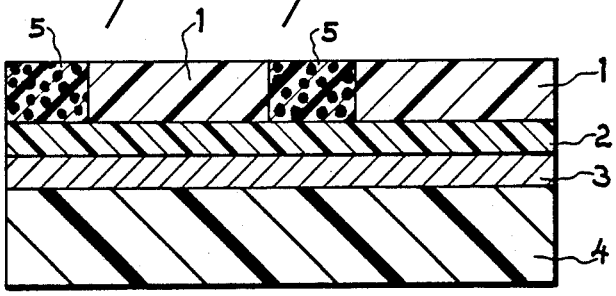
FIG. 3 shows the master of FIG. 2 after the image has been fixed.

The master is exposed imagewise using any of the procedures commonly used with silver halide photographic materials, such as by imaging with actinic light, a cathode ray tube, or laser. For negative-working emulsions the latent image 5 is then developed by reducing the exposed silver halide particles to metallic silver using a conventional aqueous developing solution, as illustrated in FIG. 2. A conventional aqueous fixing solution, such as sodium thiosulfate, is then used to remove the unexposed silver halide particles, as illustrated in FIG. 3. The developed master is then ready for the electrostatic printing process.

Figure 4:
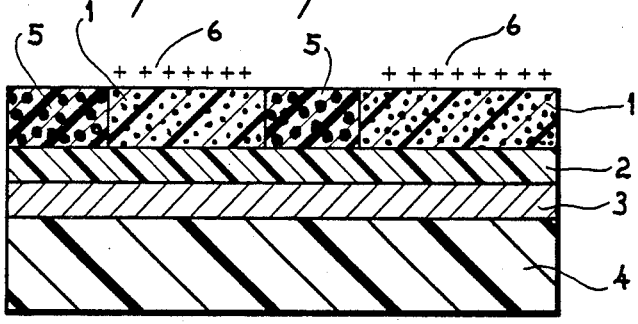
FIG. 4 shows the master of FIG. 3 after being charged.

FIG. 4 illustrates the master of FIG. 3 after it has been charged by a corona discharge that deposited positive charges 6 on the master surface. The area of the film that contains silver 5 provides a pathway for overlying charges to pass to ground, thus forming a latent image of charges that remain on the master surface. Alternatively, charging can be accomplished with the use of a negative corona discharge, shielded corotron, scorotron, radioactive source, contact electrodes such as electrically biased semiconductive rubber rollers, and the like.

Figure 5:
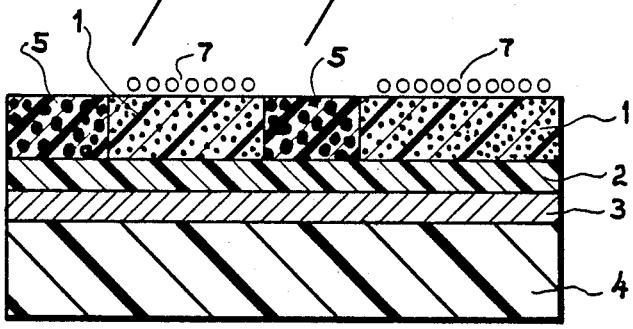
FIG. 5 illustrates the master of FIG. 4 in which toner particles have been attracted to the charged surface.
Figure 6:
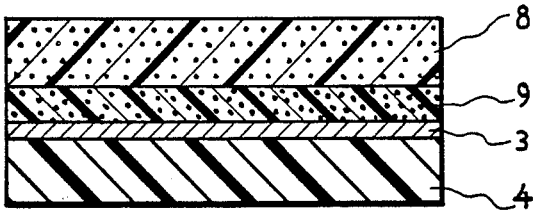
FIG. 6 is a schematic sectional view of a second embodiment in which the photosensitive layer 8 is a diffusion transfer film.

The latent image is then developed with liquid or dry toner 7 of the opposite polarity, as illustrated in FIG. 5. Cascade, magnetic brush, powder cloud, liquid, magnedry and wetting development techniques are suitable. Representative dry toners that may be used include Kodak Ektaprint K toner, Hitachi HI-Toner HMT-414, Canon NP-350F toner, and Toshiba T-50P toner. Examples of suitable liquid toners are Savin 24 toner, Canon LBP toner and James River Graphics T1818 toner. The latent image so developed ("toned") is transferred to the usual substrate, typically paper, where it is fixed in conventional fashion.

FIGS. 6 through 9 illustrate a second embodiment wherein conventional diffusion transfer techniques such as those described in U.S. Pat. Nos. 2,352,104 and 2,983,606, are used to prepare an imaged electrostatic printing master of dispersed silver in the insulating synthetic binder previously described. In this embodiment, the insulating synthetic binder 9, approximately 0.25 to 3 microns in thickness, contains dispersed development nuclei, and a photosensitive layer 8 containing silver halide salts dispersed in a hydrophilic colloid that overlays the binder, wherein the ratio of silver to binder 9 is 1:1 to 5:1. A conductive layer 3 and substrate 4 are employed as hereinbefore described. Suitable development nuclei are well-known in the art, and typically will be (1) a metal, such as silver, gold, and rhodium; (2) sulfides, selenides, tellurides, polysulfides, or polyselenides of metals including silver, zinc, chromium, gallium, iron, cadmium cobalt, nickel, manganese, lead, antimony, bismuth, arsenic, copper, rhodium, palladium, platinum, lanthanum, and titanium; (3) easily reducible silver salts which form silver nuclei during processing, such as silver nitrate or silver citrate; (4) inorganic salts which react with the incoming diffusing silver salts to form nuclei; and (5) organic compounds which (a) contain a labile sulfur atom and which therefore lead to the formation of sulfide nuclei during processing, including mercaptans, xanthates, thioacetamide, dithiooxamide, and dithiobiurate or (b) are reducing agents such hydrazine derivatives or silanes and give rise to silver nuclei when evaporated onto a silicic acids or barium sulfate. Likewise the hydrophilic colloid can be any of the substances commonly used in diffusion transfer processes, such as gelatin, phthalated gelatin, cellulose derivatives such as carboxymethylcellulose and hydroxymethylcellulose, and other hydrophilic high molecular weight colloidal substances such as dextrin, soluble starch, polyvinyl alcohol, or polystyrenesulfonic acid.

Figure 7:
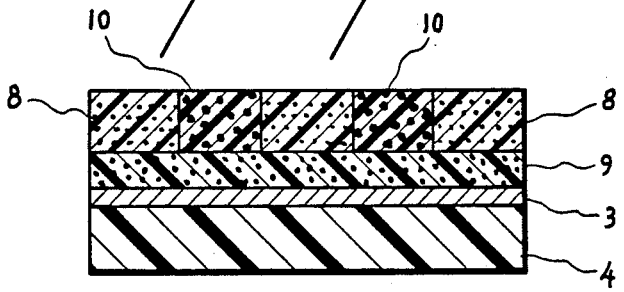
FIG. 7 shows the embodiment of FIG. 6 in which the diffusion transfer film has been imaged and development has commenced.
Figure 8:
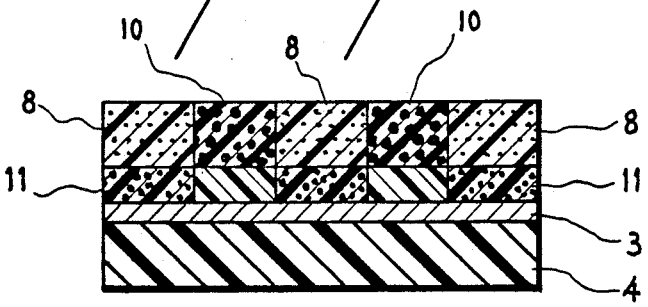
FIG. 8 shows the embodiment of FIG. 7 after development is complete.
Figure 9:
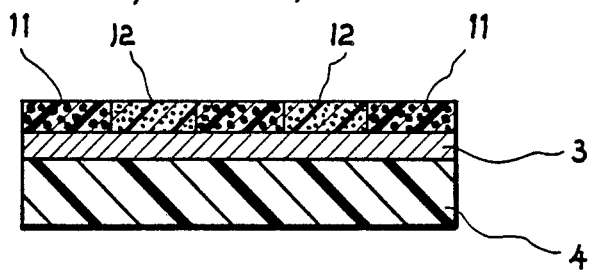
FIG. 9 shows the embodiment of FIG. 8 after the photosensitive layer 8 has been removed, at which time it is ready to be used as an electrostatic master.

Referring to FIG. 7, photosensitive layer 8 is imaged in conventional fashion to form a latent image with the sensitized silver halide. For negative-working emulsions the photosensitive layer is then treated with a developing agent that reduces the exposed silver halide to metallic silver, in area 10, and an aqueous solvent composition that converts silver halide in the unexposed areas to form a soluble silver halide complex that diffuses into the binder of layer 9 where it contacts the development nuclei and is reduced to insoluble silver particles 11, forming a silver image. Layer 8 is then removed as illustrated in FIG. 9, resulting in an electrostatic master that is ready for printing in conventional manner. Developing baths for the diffusion transfer process are well known in the art and are described, for example, in *Photographic Silver Halide Diffusion Processes* by Andre Rott and Edith Weyde (Focal Press, 1972) and *Modern Photographic Processing, Vol.* 2 by Grant Haist (Wiley, 1979).

Many additional embodiments will be evident to those skilled in the art. For example, a positive-working silver halide emulsion can be used in conjunction with the diffusion transfer coating 8 illustrated in FIGS. 6 through 9, and the exposed silver halide can be complexed in aqueous solutions to diffuse into the insulating binder layer 9, where it is reduced by the development nuclei to form the desired silver image. Similarly, a separate photosensitive film can be employed in lieu of coating 8, and brought into operative association with the insulating binder 9 before or after imaging, as in photomechanical transfer. The photosensitive silver halide emulsion layer or coating 8, and the insulating polymeric binder layer 9 may also contain compounds commonly used in diffusion transfer systems provided that the specific ingredient does not adversely affect insulating properties of the binder or conductive properties of the silver-containing area 11 of the electrostatic printing master. Thus, appropriate antifogging agents, such as tetraazaindenes and mercaptotetrazoles, coating aids, such as saponin and polyalkylene oxides, hardening agents, such as formaldehyde and chrome alum, and plasticizers may be employed if desired. The substrate 4 also can be transparent if the master is to be used as a photo-tool or for graphic arts applications.

Various conventional methods can be selected for toning the electrostatic printing master. If the toner particles are electrically conductive and essentially neutral, or charged opposite of the latent image, they will adhere to the charged latent image. If the toner is charged with the same polarity as the charged latent image, the toner will adhere to the uncharged portion. A development electrode can be used to improve the quality of the toned image; i.e., to facilitate uniform toning of solid image areas having latent electrostatic charge and to prevent background toning in image areas that contain no charge. Transfer of the toned image to the desired substrate, typically paper, can be assisted by using a corona discharge of opposite polarity on the opposite side of the substrate. Alternatively, toner transfer can be accomplished with a conductive roller that is electrically biased, adhesive film and paper, and the like. The toner image thus transferred can be fixed by a technique conventionally known in the art. Usually, heating fixation, solvent fixation, pressure fixation and the like are employed. If necessary, the surface of the master may be cleaned by using a cleaning means such as a brush, cloth, a blade, a vacuum knife and the like to remove the remaining toner image.

Electrostatic printing masters offer several advantages over those described in the prior art. Since conventional aqueous development and fixing techniques remove byproducts that are soluble in the solution used for those purposes, the master does not contain byproducts that might interfere with the insulating properties of the binder or conductive path of the developed silver image, a situation that may be encountered using the dry silver halide development techniques described in U.S. Pat. No. 4,069,759. Also, the insulating property of the binders selected in accordance with the invention is less sensitive to moisture which can interfere with the electrostatic printing process, and thus the master can be used repetitively or after storage without the need to heat the master to remove moisture or to undertake special humidity controls.

High resolution may be obtained using the electrostatic printing masters provided by the invention, achieving results comparable to that obtained in high-quality lithographic, flexographic, and letter press printing. While half-tone imaging will normally be selected for these applications, it is possible to tailor a master for continuous tone applications since the density of developed silver will vary with intensity of light used to image the film, as in conventional photography.

The following examples further illustrate various embodiments of the invention, and are not to be construed to limit it. Other embodiments will be apparent to those skilled in the art. In the examples, all parts and percentages are by weight, and all temperatures are in degrees Celsius, unless otherwise stated.

Unless otherwise stated, the silver halide emulsions were negative working and sensitized with gold and sulfur-containing compounds in a conventional manner. The silver chloride was doped with 0.13 millimoles of $RhCl_3$ per mole of silver.

The following abbreviations were used for the cross-linking agents:

0500: Epoxy Resin 0500; triglycidyl p-aminophenol-derived epoxy resin (Ciba-Geigy Corp., Ardsley, N.Y.)

510: Epi-Rez® WD-510; diglycidyl ether of bisphenol-A (Celanese Corp., Louisville, KY.); CAS 1675-54-3

4221: ERL-4221; cycloaliphatic diepoxide, Union Carbide Corp.; (3,4-epoxycyclohexyl)methyl 3,4-epoxycyclohexanecarboxylate; CAS 2386-87-0

5022: Epi-Rez® 5022; diglycidyl ether of 1,4-butanediol (Celanese Corp., Louisville, KY.); CAS 2425-79-8

5044: Epi-Rez® 5044; triglycidyl ether of ethoxylated trimethylolpropane (Celanese Corp., Louisville, KY.); CAS 52495-71-3

HDU: N,N'-hexamethylene-1,6-bis(1-aziridinecarboxyamide); CAS 2271-93-4

MEDEI: N,N'-diphenylmethane-4,4'-(1-aziridinecarboxyamide); CAS 7417-99-4

MY-721; Araldite® MY-721, tetraglycidylmethylenedianiline resin (Ciba-Geigy Corp., Ardsley, N.Y.)

PT-810: Araldite® PT-810, triazine-based epoxy resin (Ciba-Geigy Corp., Ardsley, N.Y.)

XAMA-7: tetramethylolmethane-tri-beta-aziridinylpropionate; Cordova Corp.

XUGY-281: Araldite® XUGY-281; diglycidyl ether of bisphenol F (Ciba-Geigy Corp., Ardsley, N.Y.)

MK-107: Diglycidyl ether of cyclohexanedimethanol (Wilmington Chemical Corp., Wilmington, DE.)

WC-67: Diglycidyl ether of 1,4butanediol (Wilmington Chemical Corp., Wilmington, DE.)

WC-68: Diglycidyl ether of neopentyl gylcol (Wilmington Chemical Corp., Wilmington, DE.)

PREPARATION OF POLYMERS

The general procedure for the preparation of the polymers is illustrated by the preparation of Polymer A [styrene/methyl methacrylate/ethyl acrylate/methacrylic acid in a 30/10/40/20 weight ratio] as given below.

To a five liter flask fitted with a high speed stirrer, a reflux condenser, an addition funnel and a thermometer were charged 788 grams of deionized water, 5 grams of Duponol WAQE (sodium lauryl sulfate), 35.2 grams of styrene, 11.7 grams of methyl methacrylate, 46.9 grams of ethyl acrylate, 23.4 grams of methacrylic acid, and 0.5 grams of octyl mercaptan. The flask was purged with nitrogen and heated to 60° C. and held for 15 minutes. Ferrous ammonium sulfate, 0.02 grams, ammonium persulfate, 0.28 grams, and sodium bisulfite, 0.28 grams, were added to the flask while the mixture was emulsified and maintained at 69°–74° C. A mixture of 316.5 grams of styrene, 105.5 grams of methyl methacrylate, 422 grams of ethyl acrylate, 211 grams of methacrylic acid and 5.10 grams of octyl mercaptan was added to the flask over a period of 140 minutes while a solution containing 2.06 grams of ammonium persulfate, 0.52 grams of sodium bisulfite and 19.4 grams of Duponol WAQE in 1000 grams of deionized water was also added over the 140 minutes. Polymerization was continued for an additional hour and the emulsion was allowed to cool slowly to ambient temperature. A 5% calcium acetate solution was added whereupon the polymer coagulated. It was strained from excess water, washed and filtered repeatedly with deionized water until the filtrate became clear, and vacuum dried. Polymers B-I were prepared in a similar manner. The polymer compositions and acid numbers are given in the Table 2 below. The acid numbers are defined as the milligrams of potassium hydroxide neutralized per gram of polymer as determined by potentiometric titration.

TABLE 2

| | | Monomers[a] | | | | | | | |
|---|---|---|---|---|---|---|---|---|---|
| Polymer | S | MMA | EA | EMA | EHMA | AA | MAA | MAM | AN |
| A | 30 | 10 | 40 | | | | 20 | | 124 |
| B | 25 | 40 | 20 | | | | 15 | | 94 |
| C | 27 | | 60 | | | | 13 | | 80 |
| D | 30 | | 53 | | | | 17 | | 100 |
| E | 25 | | 21 | 30 | | | 24 | | 151 |
| F | 35 | 13 | 28 | | | | 24 | | 152 |
| G | 25 | 40 | 20 | | | 15 | | | 81 |
| H | | 51 | 29 | | | | 20 | | 135 |
| I | | | 45 | 40 | | | 15 | | 97 |
| J | | 42.8 | | 43 | | | 10 | 4.2 | |
| K | 30 | 10 | | 40 | | | 20 | | |
| L | 30 | | | | 50 | 20 | | | |

[a]S = styrene
MMA = methyl methacrylate
MMA = ethyl acrylate
EHMA = 2-ethylhexyl methacrylate
AA = acrylic acid
MAA = methacrylic acid
MAM = methacrylamide
AN = acid number Examples 1–11 demonstrate the charge retention of the different polymers when used with different silver halides and at different silver halide to polymer ratios.

EXAMPLES 1–6

A solution was made from the following ingredients:

| | |
|---|---|
| polymer[a] | 0.5 grams |
| triethylamine | 0.3 grams |
| water | 3.2 grams |

[a]Example 1 = Polymer A
Example 2 = Polymer B
Example 3 = Polymer C
Example 4 = Polymer D
Example 5 = Polymer E
Example 6 = Polymer F To this solution was added with stirring 12.5 grams of a 15.1% solution of a silver chloride emulsion (AgCl grains doped with 0.13 millimoles of $RhCl_3$ per mole of AgCl and with a median edge length of 0.13 to 0.17 microns) containing 3.3 grams of gelatin per mole of silver chloride. The dispersion was coated onto a copper-clad polyester base by doctor knife. The dried films were 2.4 microns thick and had 90 milligrams of silver chloride per square decimeter, with a silver ion to polymer ratio of 2.8 to 1. The unexposed films were tray-processed according to the following procedure: 1 minute in a commercial lithographic developer (CUFD, E. I. du Pont de Nemours and Company) at 32.2° C., 30 seconds in 30% sodium thiosulfate fixer and 15 seconds in 2% acetic acid stop both at 25° C., followed by cold water washing and drying at 125° C. for 10 minutes. The processed films were mounted on a flat plate, the copper layer connected to ground, and equilibrated at 24° C. and the given relative humidity for one hour. They were then corona charged (with a double wire corotron) at 8.2 kv. Charging was stopped (at time=0) and the charge allowed to decay. Electrostatic voltages were determined with the use of an electrostatic surface probe. The results, in voltages per micron, are summarized in the Table 3 below.

TABLE 3

| | Example | | | | | |
|---|---|---|---|---|---|---|
| Time (sec) | 1 | 2 | 3 | 4 | 5 | 6 |
| | RH = 23% | | | | | |
| 2 | 55 | 55 | 41 | 65 | 39 | 63 |
| 15 | 53 | 53 | 39 | 59 | 38 | 58 |
| 60 | 51 | 52 | 37 | 54 | 36 | 53 |
| | RH = 50% | | | | | |
| 2 | 37 | 36 | 30 | 27 | 28 | 44 |
| 15 | 31 | 35 | 26 | 16 | 25 | 38 |
| 60 | 26 | 33 | 23 | 11 | 22 | 33 |

EXAMPLES 7–10

A solution was made from the following ingredients:

| | |
|---|---|
| polymer[a] | 32.7 grams |
| triethylamine | 11.5 grams |
| water | 131 grams |

[a]Example 7 = Polymer G
Example 8 = Polymer H
Example 9 = Polymer I
Example 10 = RESYN 28-1300 (National Starch Co.), -continued

| | |
|---|---|
| carboxylated Poly(vinyl acetate) with acid number of 67. | |

To this solution was added with stirring 74.2 grams of the silver chloride as in Examples 1-6 but containing 33.3 grams of gelatin per mole of silver chloride. The dispersion was coated on copper-clad polyester base as in the previous examples. The dried film had a thickness of 4 microns with a silver weight of 80 milligrams per square decimeter. The ratio of silver ion to binder was 1.15 to 1. Films were developed in a commercial X-ray film developer (MXD, E. I. du Pont de Nemours and Company) and fixer (thiosulfate) at ambient temperature. They were treated with 2% acetic acid, water-rinsed and dried at 125° C. for 10 minutes. After equilibration at 24° C. and 37% relatively humidity, the processed films were corona charged as described in the previous examples. The results, in voltages per micron, are summarized in Table 4 below.

TABLE 4

| | Example | | | |
|---|---|---|---|---|
| Time(sec) | 7 | 8 | 9 | 10 |
| 2 | 62 | 22 | 55 | 6 |
| 30 | 53 | 13 | 33 | 5 |
| 60 | 49 | 10 | 25 | 5 |
| 120 | 44 | 7 | 20 | 4 |

EXAMPLE 11

Example 9 was repeated except that a silver iodobromide emulsion ($AgBr_{0.985}I_{0.015}$ with an average grain volume of 0.0185 cubic microns) containing 13.3 grams of gelatin per mole of silver halide was substituted for the silver chloride. The dry film had a coating thickness of 4 microns and contained 80 milligrams of silver halide per square decimeter. The ratio of silver ion to polymer was 1.15 to 1. The film was processed and charged as in Examples 7-10. At 24° C. and 37% relative humidity, the electrostatic voltages held per micron in the polymer areas were 80, 56, 47, and 40 volts per micron at 2, 30, 60, and 120 seconds respectively.

Examples 12-17 demonstrate the use of different conductive substrates with two different insulating polymers.

EXAMPLE 12

Polymer J [methacrylamide/methyl methacrylic acid/ethyl acrylate/methacrylic acid in a 4.2/42.8/43/10 ratio] was prepared as follows: a mixture of 4.2 grams of methacrylamide, 42.8 grams methyl methacrylate, 43 grams ethyl acrylate, 10 grams methacrylic acid and 0.1 grams VAZO 64 initiator (azobisisobutyronitrile) in 666 grams t-butanol was heated at reflux under a nitrogen atmosphere for two hours. Another 0.1 grams of VAZO was added, refluxing continued for two hours, two more additions made of 0.1 grams of VAZO, and refluxing continued to a total reaction time of 8 hours. The polymer was precipitated in cold water, rinsed with water, and dried to a white powder.

A solution was made of the following ingredients:

| | |
|---|---|
| Polymer J | 5.0 grams |
| triethylamine | 0.5 grams |

-continued

| | |
|---|---|
| water | 35.0 grams |

To 5 grams of the polymer solution was added with stirring 9.9 grams of an ortho-sensitized silver iodobromide emulsion as in Example 11 in which the gelatin content was 13 grams of gelatin per mole of silver halide and the silver halide content was 11.7%. The dispersion was coated under red safelight conditions onto aluminum using a wire-wound bar to give, after drying, a coating of 6.0 microns.

The coating was handled and processed under red safelights. Images were prepared by contact exposure to halftone and resolution targets in a vacuum frame using a tungsten lamp at 56 inches (lamp output=10 foot candles 12 inches from the bulb). This example was exposed one second, tray developed for 1 minute under nitrogen atmosphere is the following developer:

0.01% potassium bromide
0.05% sodium sulfite
1.00% hydroxylamine hydrochloride
0.01% Dimezone-S
1.00% hydroquinone
5.40% potassium carbonate
5.40% potassium bicarbonate deionized water It was then fixed 2 minutes, stopped 2 minutes in 2% acetic acid, rinsed 2 minutes in distilled water all at 26° C., blown dry, and heated 1 minutes at 125° C.

The image consists of black silver image where the coating was exposed and a white background where unexposed. Resolution was at least 101 line pairs per millimeter. Charge acceptance and dark decay were determined using a Monroe Model 276A static charge analyzer. The exposed areas read initial acceptance of 8 volts which is the same as an aluminum blank, and did not decay over 60 seconds; the unexposed areas initially accepted 153 volts which decayed to 100 volts at 10 seconds, 92 volts at 20 seconds, 75 volts at 60 seconds. This difference in charge between the exposed and unexposed areas is useful for electrostatic toning.

The electrostatic master was charged with a positive corona to maximum acceptance charge while the aluminum support was electrically grounded. After a few seconds decay the ground was disconnected and the plate immersed in a dispersion of negatively charged black toner particles in Isopar ®, a nonpolar hydrocarbon liquid having a Kauri-butanol value of about 27, Exxon Corp. Toner was attracted to the white non-silver parts of the image making the overall master look black. It was then rinsed gently in a tray of Isopar ®, drained, rewet with Isopar ®, covered with paper, and passed under the positive corona to assist toner transfer to paper. The image transferred normally (toner transferred where the master was silver-free) and had 6 line pair/millimeter resolution when the master stayed wet with Isopar ®throughout.

EXAMPLE 13

The procedure in Example 12 was repeated with the following exceptions: the emulsion was coated onto copper-clad Kapton ® (polyimide film, E. I. du Pont de Nemours and Company) to achieve a thickness of 5.7 microns; and the processed film was heated for 5 minutes at 125° C. The finished electrostatic master thus prepared was mounted on a Savin 770 copier drum and charged and toned, the image transferred to paper as in Example 12, to obtain 100–150 copies of black toner image with resolution of 20 line pairs per millimeter.

EXAMPLE 14

Example 12 was repeated except that 9.9 grams of polymer solution was used, resulting in a silver ion to polymer ratio of 0.58 to 1; and the dispersion was coated on copper-clad Kapton® with a coating thickness of 5.7 microns. The subsequent treatment was the same as in Example 13. The master appeared to charge and tone better with the higher percent polymer (Example 14), but the image coating had a greater tendency to delaminate.

EXAMPLE 15

Example 12 was repeated except that the conductive substrate used was aluminized Mylar® (polyester film, E. I. du Pont de Nemours and Company). This resulted in an intact image with no noticeable anchorage or quality problems.

EXAMPLE 16

Polymer K was prepared in the same manner as Polymer J, but using 4.2 grams of methacrylamide, 21.8 grams methyl methacrylate, 64 grams ethyl acrylate, and 10 grams methacrylic acid. The films were prepared, imaged, processed, charged and toned as in Example 12. Charge acceptance initially was 55 volts; at 10 seconds it was 16 volts.

EXAMPLE 17

This example used the same coating and processing as Example 13 except that the image was heated for 10 minutes at 125° C. A coating thickness of 1.8 microns was achieved. Image areas that air dried before heating (A) were somewhat cloudy; areas that were wet when placed in the oven (B) were transparent after heating. The black silver image had resolution of 228 line pairs per millimeter. The charge acceptance and decay of the image was determined on a Monroe 276A Static Charge Analyzer at various relative humidities as shown in the Table 5 below. The data are in volts per micron.

TABLE 5

| Relative Humidity | | 0 seconds | 10 seconds | 20 seconds | 30 seconds |
|---|---|---|---|---|---|
| 4% | A | 75 | 58 | 53 | 47 |
| | B | 50 | 40 | 34 | 32 |
| 20% | A | 70 | 50 | 43 | 38 |
| | B | 48 | 32 | 27 | 24 |
| 35% | A | 54 | 29 | 23 | 19 |
| | B | 36 | 17 | 13 | 11 |
| 49% | A | 53 | 24 | 18 | 15 |
| | B | 35 | 13 | 9 | 7 |
| 63% | A | 18 | 5 | 2 | — |
| | B | 11 | 2 | — | — |
| 72% | A | 21 | — | — | — |
| | B | 9 | — | — | — |

The copper layer of the electrostatic master of Example 17 was electrically grounded and the image positively charged with a corona under ambient conditions. After a few seconds the grounded image was submerged in a toner bath consisting of negatively charged toner particles in Isopar®, drained, lightly rinsed with Isopar® and the wet image transferred to paper with the help of a negative corona behind the paper. The toner image was positive with respect to the original image, negative with respect to the master, and resolution was 16 line pairs per millimeter. The electrostatic master was recharged and toned and the toner image allowed to dry. Clear adhesive tape picked the toner off the master to give a clean positive image with respect to the original, with resolution of 50 line pairs per millimeter.

EXAMPLES 18–24

These examples contrast the properties of films formed by dispersing a silver salt in gelatin binders to those formed by dispersing the same silver salt in the improved insulation media of the present invention. In all cases the silver salt used was AgCl grains doped with 0.13 millimoles of $RhCl_3$ per mole of AgCl with and with a median edge length of 0.13 to 0.17 microns. The charge retention was measured after developing the unexposed films.

(i) Films with Gelatin Binders

A silver chloride dispersion was prepared by adding 3610 grams of silver chloride curds (grains doped with 0.13 millimoles of $RhCl_3$ per mole of AgCl and with a media edge length of 0.13 to 0.17 microns) containing 13.3 grams of gelatin per mole of AgCl to 3045 grams of water, adjusting the pH to 6.7 with 130 grams of 0.1 N sodium hydroxide, heating and stirring for one hour at 45° C. and adding 214 grams of a solution made up by mixing 165.2 g 0.1 N sodium hydroxide, 32.1 grams tetraazaindene stabilizer*, and 16.7 grams water.

* tetraazaindene = 4-hydroxy-2-methyl-[1,2,4]triazole[2,3-b]pyrimidine

Gelatin was swollen in water at 20° C. and then dissolved in additional water at 50° C. to give a 15 wt% solution. 295 grams of the gelatin solution was then added to 705 grams of the AgCl solution to make a net 17.63 wt% AgCl emulsion. Formaldehyde hardener was added at a concentration of 5 grams formaldehyde per 1000 grams emulsion. The emulsion was coated onto an indium tin oxide coated polyester substrate (surface resistivity of about 500 ohms per square, 5 mil thick polyester base) using a lab coater. The films were tray processed using standard reagents in the following sequence: developer, stop, fix, stop, rinse, dry. The gelatins used and the coating thicknesses after processing obtained are summarized in Table 6.

(ii) Films with Improved Polymeric Binders

A solution was made from the following ingredients:

| | |
|---|---|
| polymer | 2.00 grams |
| water | 10.44 grams |
| isopropanol | 3.20 grams |
| potassium hydroxide | 0.30 grams |
| potassium bicarbonate | 0.06 grams |
| acid violet 520 dye | 0.10 grams |

To this solution was added with stirring 54 grams of AgCl curds containing 10 grams gelatin per mole of AgCl. The dispersion was coated onto a gel-subbed indium tin oxide coated polyester substrate (surface resistivity of about 500 ohms per square, 5 mil thick polyester base) using a wire-wound rod. The films were processed following the procedure described for the gelatin films. The polymers used and the coating weights obtained are summarized in Table 6.

TABLE 6

| Example | Binder | Coating Thickness (μm)[a] |
|---|---|---|
| 18 | 2688 deionized gelatin | 5.2 |
| 19 | 2688 deionized gelatin | 1.8 |
| 20 | Rousselot ILLS non-deionized gelatin | 5.8 |
| 21 | Rousselot ILLS non-deionized gelatin | 2.8 |
| 22 | Polymer A | 1.6 |
| 23 | Polymer E | 0.9 |
| 24 | Polymer E | 1.4 |

[a] after processing (iii) Determination of Charge Retention

Samples of the above films were mounted on an aluminum plate and electrical connection from the conductive indium tin oxide substrate to ground was made with the use of conductive copper tape. The films were equilibrated in a glove box at a given relative humidity as measured with an Omega hand held hygrometer (Model RH-201) for one hour and then corona charged with a double wire corotron, 6 kV being applied to the corotron. Voltages were determined with the use of an electrostatic surface voltage probe. The results are summarized in terms of volts per micron in Table 7.

TABLE 7

| Time (sec) | Example 18 | 19 | 20 | 21 | 22 | 23 | 24 |
|---|---|---|---|---|---|---|---|
| | T = 24° C. | | | RH = 11% | | | |
| 2 | 34 | 61 | 13 | 35 | 123 | 122 | 99 |
| 15 | 18 | 27 | 3 | 15 | 91 | 97 | 69 |
| 30 | 13 | 19 | 2 | 10 | 81 | 87 | 59 |
| Time (sec) | Example 18 | 19 | 20 | 21 | 22 | 23 | 24 |
| | T = 23° C. | | | RH = 30% | | | |
| 2 | 4 | 10 | 1 | 3 | 86 | 89 | 51 |
| 15 | 1 | 3 | 0 | 0 | 41 | 49 | 27 |
| 30 | 0 | 2 | 0 | 0 | 33 | 41 | 21 |
| Time (sec) | Example 18 | 19 | 20 | 21 | 22 | 23 | 24 |
| | T =22° C. | | | RH = 48% | | | |
| 2 | 1 | 1 | 0 | 1 | 37 | 34 | 21 |
| 15 | 0 | 0 | 0 | 0 | 13 | 17 | 9 |
| 30 | 0 | 0 | 0 | 0 | 8 | 13 | 6 |

Films with gelatin binders were heated to determine the effect on the electrostatic properties. Films in Examples 18–21 were dried at 100° C. for 10 minutes and then conditioned at 48% relative humidity for 1 to 10 minutes after which electrostatic data were obtained. These data in volts per micron are summarized below in Table 8.

TABLE 8

| Time(sec) | Example 18 1 min | 18 10 min | 19 1 min | 19 10 min | 20 1 min | 20 10 min | 21 1 min | 21 10 min |
|---|---|---|---|---|---|---|---|---|
| 2 | 25 | 5 | 18 | 4 | 6 | 1 | 15 | 1 |
| 15 | 10 | 0 | 3 | 1 | 1 | 0 | 2 | 0 |
| 30 | 5 | 0 | 1 | 1 | 0 | 0 | 1 | 0 |

(iv) Toning Results

Films from Examples 18–24 were toned with liquid electrostatic toner containing carbon black pigment in a modified Savin 870 copying machine under identical conditions, the temperature was 19° C. and the relative humidity was 48%. Time from corona charging to toning was 15 seconds. The double wire corotron was biased at 6 kV and the development electrdoe was maintained at ground potential. Transfer of the toner from the film surface to offset enamel paper was accomplished with the use of a bias transfer roll. Once transferred to paper, the toner was thermally fused at 100° C. in an oven. Reflection optical density measurements were made with the use of a Macbeth RD918 densitometer and are given in the Table 9 below.

TABLE 9

| Example | Ambient | Heated[a] |
|---|---|---|
| 18 | 0.02 | 0.56 |
| 19 | 0.02 | 0.30 |
| 20 | 0.02 | 0.20 |
| 21 | 0.02 | 0.27 |
| 22 | 1.51 | |
| 23 | 1.34 | |
| 24 | 1.11 | |

[a]Heated for 10 minutes at 100° C. followed by 1 minute conditioning at ambient conditions prior to toning.

Examples 26 and 27 illustrate the use of a commercial resin as the insulating polymeric binder.

EXAMPLE 25

In 35 grams of water was dissolved 2.5 grams of Carboset® 526 (copolymer of ethyl acrylate/methyl/methacrylate/acrylic acid in a 17/71/12 ratio, B. F. Goodrich Co.) and 0.59 grams of triethylamine. Equal amounts of the polymer solution and silver halide emulsion of Example 12 were blended and coated at 60 milligrams per square decimeter on copper clad Kapton®. Exposure and development following the procedure in Example 12 resulted in a black silver image with a clear background with good resolution. Charging and charge decay studies as a function of relative humidity were conducted on coatings of pure Carbonset® 526 at 36.90 milligrams per square decimeter on copper under the same conditions as Example 17. At 4 to 72% relative humidity Carboset® 526 held charge at least as well or better than Polymer J of Example 12.

EXAMPLE 26

Example 25 was repeated using Carboset® 525 (copolymer of ethyl acrylate/methyl methacrylate/acrylic acid in a 56/37/7 ratio, B. F. Goodrich, Co.). An image was produced, however it was weaker than that of Example 26.

EXAMPLE 27

A film was prepared as in Example 1 except that the AgCl emulsion contained 13.3 grams of gelatin per mole of AgCl and the final coating weight was 120 milligrams per square decimeter. The film was exposed and processed in MXD (E. I. du Pont de Nemours and Company, Inc.) rapid access Xray film developer so as to get a variety of amounts of silver developed. Development was determined by a Panalyzer 4000 (Panametrics, division of Esterline Corp.). Surface resistance in the silver image areas was measured with a Fluka 77 Multimeter (John Fluke Mfg. Co., Inc.) between two probes 1 centimeter apart. Acceptance voltage in the silver image areas was measured on a Monroe 276A static test meter. The results are given below in Table 10.

TABLE 10

| % Silver Developed | Resistance (ohms) | Acceptance Voltage (volts) |
|---|---|---|
| 100 | 70 | 4 |
| 96 | 1000 | 7 |
| 92 | 200 | 6 |
| 82 | $10^7$ | 25 |
| 47 | — | 88 |
| 30 | — | 155 |
| 9 | — | 262 |

EXAMPLE 28

Indium tin oxide coated Mylar® (polyester film) was coated with a 1.8 milligram per square decimeter subbing of polyvinylidine chloride resin at 200 feet per minute with a fountain air knife coater, and heat set at 170° C. at 20 fpm giving a residence time of 8 minutes. This was overcoated with a gelatin layer at 0.8–1.0 milligrams per square decimeter at 200 fpm with a fountain air knife and heat relaxed at 145° C. at 45 fpm giving a residence time of 3.5 minutes.

A solution of Polymer E was prepared by adding to 2314 grams of water with stirring: 450 grams isopropyl alcohol (95%), 450 grams methyl ethyl ketone, and 132 grams potassium hydroxide pellets. To this solution was added with rapid stirring 600 grams of Polymer E; stirring was continued until it was mostly dissolved (15 minutes). To this was added 54 grams of potassium bicarbonate. A silver chloride dispersion was prepared by adding 3610 grams of silver halide curds (grains doped with 0.13 millimoles of $RhCl_3$ per mole of AgCl and with a median edge length of 0.13 to 0.17 microns) containing 10 grams gelatin per mole of silver chloride to 2300 grams of water and adjusting the pH to 6.7 by the addition of 130 grams of 0.1N sodium hydroxide and 15 grams of 0.1N sulfuric acid. This was heated for 1 hour at 45° C. and 214 grams of a solution made up of 386 grams of 0.1N sodium hydroxide, 75 grams of tetraazaindene stabilizer, and 39 grams water was added. This was diluted to 25% silver chloride with 614 grams water.

To 630 grams of the 25% AgCl solution was added slowly with stirring 247 grams of the polymer solution (15%). Before coating 6.7 grams of EPI-REZ 5022 (diglycidyl ether of 1,4-butanediol, Celanese Corp.) was added and coated onto the above treated indium tin oxide Mylar® sheet at 15 milligrams per square decimeter polymer coating weight usign a lab coater at 60 fpm. This was dried for 30 seconds at 10° C., 60 seconds at 30° C., and 60 seconds at 50° C. Total dry coating weight was 103 milligrams per square decimeter.

After exposure and development as in Examples 18–24 the developed exposed silver image had surface resistance of 50–100 ohms and acceptance voltage of 1 volt as measured 2 seconds after charging. The unexposed non-silver part of the image had an acceptance voltage of 242 volts as measured 2 seconds after charging, 206 volts after 15 seconds, and 190 volts after 30 seconds at 19% relative humidity. Toning in a modified Savin 870 Office Copier as described in Example 18–24 gave 5–98% dots and 150 lines per millimeter resolution. The image transferred to paper had a $D_{max}$ of 2.4 and a $D_{min}$ of 0.03.

EXAMPLE 29

In this example the invention is illustrated by a diffusion transfer film. To the following solution

| | |
|---|---|
| water | 3116 grams |
| ammonium hydroxide (29%) | 84 grams |
| isopropyl alcohol (95%) | 400 grams |

was added with intense stirring 400 grams of ground Polymer A. This solution was left unstirred until polymer dissolved (overnight). To 1720 grams of the polymer solution was added over 1 minute with rapid stirring 600 grams of a 2% solution of zinc sulfate; then added over 5 seconds with stirring 210 grams of a 1.062% solution of sodium sulfide; then over 30 seconds added 520 grams of 2.59% solution of acid violet 520 (antihalation dye). This was diluted to 4% by the addition of 1250 grams of water. Before coating, 31 grams of EPI-REZ 5022 (diglycidyl ether of 1,4-butanediol) was added. The solution was coated using a fountain airknife at the following conditions: 200 fpm, 4 inch air knife pressure; onto 5 mil thick Mylar® (polyester) previously sputtered with indium-tin oxide. This was dried at 85° C. This film was subsequently heat relaxed on a separate pass at 145° C. and 45 fpm giving a residence time of 3.5 minutes at 145° C. This was overcoated with a blue-sensitized camera speed high contrast emulsion of $AgCl_{0.8}Br_{0.195}I_{005}$ (average grain volume=0.01 cubic microns) dispersed 2:1 in gelatin using a bar coater at 80 fpm. The final binder layer coating weight was 9.3 milligrams per square decimeter; the emulsion layer was 73.6 milligrams per square decimeter. The ratio of silver ion to polymer was 3.0 to 1. The film was exposed and developed with very little agitation for 1 minute in Agfa CP297B (Agfa-Gaevert) diffusion transfer developer at 28° C., agitated for 1 minute in 10% acetic acid stop solution at 28° C. removing much of the gelatin top layer, rinsed in 15° C. water, and dried at room temperature.

The unexposed areas gave developed silver in the polymeric binder layer with surface resistance of 20–35 ohms and acceptance voltage of 0 volts. The exposed areas were silver-free in the polymeric binder layer and after charging, the acceptance electric field at 38% relative humidity was 150 volts at 2 seconds; 104 volts at 15 seconds; 91 volts at 30 seconds. Toning in a modified Savin 870 copying machine as described in Examples 18–24 gave 4–98% halftone dots/150 line per inch halftone. The $D_{max}$ was 2.5 and the $D_{min}$ was 0.01.

EXAMPLES 30–31

These examples contrast the properties of diffusion transfer films which contain either gelatin or a styrene-acrylic tetrapolymer as the binder in the receptor layer.

(i) Diffusion Transfer Film with Gelatin Binder in the Receptor Layer (Example 30)

60 grams of Rousselot Ills gelatin were added to 1360 milliliters of deionized water and allowed to stir at room temperature with fast agitation for 20 minutes. The suspension was heated to 52° C. for 30 minutes and then cooled to 35° C. 106 milliliters of a 0.15M zinc sulfate solution and 6 milliliters of a 0.15M iron(II) sulfate solution were added over a 1 minute interval. 336 milliliters of a 0.05M sodium sulfide solution was added through an orifice so that the addition time was approximately 2 minutes. The following aqueous solutions were then added:

| | |
|---|---|
| 15%solution of Polystep B-27 (Stepan Chemical Co.) | 60 ml |
| 1.33 M formaldehyde | 40 ml |
| 0.264M chromium potassium sulfate | 40 ml |

The solution was immediately coated onto the conductive side of indium tin oxide coated Mylar® at a coating weight between 0.7 and 1.0 grams per square meter of gelatin.

An ortho sensitized camera speed high contrast emulsion of $AgCl_{0.7}Br_{0.3}$ (average grain volume approximately 0.025 cubic microns) was coated onto the gelatin layer at a silver coating weight of 3.1 grams per square meter. The emulsion contained no hardener.

The multilayer film was exposed imagewise with a tungsten light and developed in Commercial AgfA PMT developer (Type CP297B) for 60 seconds at approximately 20° C. with little agitation. The emulsion layer was then removed with pressurized water at 38° C. The sample was washed for 2 minutes in 38° C. water and dried at room temperature.

(ii) Diffusion Transfer Films with Improved Polymeric Binders (Example 31)

To a solution of 4.0 grams of Polymer E and 2.5 grams of triethylamine in 80 grams of water was added over 1 minute 6 milliliters of a 4% aqueous solution of zinc sulfate, then over 5 seconds 19.2 milliliters of a 0.23% aqueous solution of sodium sulfide. After stirring 5 minutes the precipitate was filtered off and the solution containing the zinc sulfide nuclei was coated on the conductive side (surface resistivity=500 ohms per square) of indium tin oxide coated Mylar® to give 7 milligrams per square decimeter clean colorless polymeric receptor layer with 1% zinc sulfide nuclei. This was heated at 125° C. for 10 minutes to improve adhesion to the conductive substrate.

A blue-sensitized camera-speed high contrast conclusion of $AgCl_{0.80}Br_{0.195}I_{0.005}$ (grains of average volume of 0.01 cubic microns) dispersed 2:1 in gelatin was coated without hardener over the polymeric receptor layer at a coating weight of 69 milligrams per square decimeter.

The multilayer coating was exposed imagewise with light and developed in the commercial Kodak PMT-D developer (Eastman Kodak Co., Chicago, Ill.) modified with 12.5% potassium hydroxide and 5% potassium carbonate for 60 seconds at 28° C. with little agitation. The developed image was agitated 30 seconds in 10% acetic acid stop solution at 28° C. removing most of the top gelatin layer. The black positive diffusion transfer image in the receptor layer remained on the conducting support and was rinsed free of gelatin and loose silver residues with 40° C. water, dried, heated 5 minutes at 125° C. to clean out volatile contaminants. The image had $D_{max}$ of 3.0–3.5 and low $D_{min}$.

The receptor areas corresponding to unexposed image had 8.8 milligrams per square decimeter finely divided black silver metal dispersed in 6.6 milligrams per square decimeter polymer matrix. The ratio of silver to polymer of 1.34 to 1 is above the threshold of about 1.2 and the surface resistance in silver containing areas was very low, 5 to 14 ohms. The areas corresponding to the exposed image were fairly clean, nearly colorless and had surface resistance of greater than $10^7$ ohms. The master was toned on a modified Savin 870 copying machine as in Examples 18–24. With a 50 volt development electrode potential the background of the toner image transferred to paper (corresponding to the silver areas of the master) was completely clean of toner and with halftone dots of 2–95%/150 line per inch halftone.

(iii) Electrostatic Data

Data were obtained for the diffusion transfer films in Examples 30–31 at various relative humidites according to the procedure described for Examples 18–24. The temperature was 22° C. in all cases. The results in volts per micron are summarized in Table 11.

TABLE 11

| Time (sec) | Example 30 | Example 31 |
|---|---|---|
| | RH = 11% | |
| 2 | 15 | 45 |
| 15 | 0 | 17 |
| 30 | 0 | 13 |
| | RH = 30% | |
| 2 | 0 | 34 |
| 15 | 0 | 17 |
| 30 | 0 | 12 |
| | RH = 49% | |
| 2 | 0 | 23 |
| 15 | 0 | 12 |
| 30 | 0 | 8 |

The diffusion transfer film with gelatin as binder, Example 30, was heated at 100° C. for 10 minutes followed by conditioning at 48% relative humidity for 1 or 10 minutes. The electrostatic data, in volts per micron, obtained immediately after conditioning are given in Table 12 below.

TABLE 12

| Time (sec) | Conditioning Time 1 min | Conditioning Time 10 min |
|---|---|---|
| 2 | 35 | 15 |
| 15 | 9 | 1 |
| 30 | 4 | 1 |

(iv) Toning Results

Films from Examples 30–31 were toned at 21° C. and 43% relative humidity as in Examples 18–24. Reflection optical densities measured as in Examples 18–24, are given in the Table 13 below.

TABLE 13

| Example | Optical Density Ambient | Optical Density Heated[a] |
|---|---|---|
| 30 | 0.00 | 0.73 |
| 31 | 1.83 | |

[a]Heated at 100° C. for 10 minutes followed by conditioning for 1 minute at ambient conditions.

EXAMPLE 32

The solution of polymer E containing ZnS development nuclei as described for Example 31 was coated on gelatin subbed polyester film at 28 milligrams per square decimeter giving a clear colorless coating. A piece of Kodak PMT Negative Paper was exposed imagewise. The exposed PMT paper and receptor polymer/nuclei coating were fed into the nip of a laminator with the paper emulsion side facing the nuclei coating and the sheets spread apart. Kodak PMT-D developer was applied at the nip between the sheets, the sheets were wet laminated together at 1 meter per minute under light nip pressure, the laminate was held 30 seconds at room temperature and then the sheets were separated to give a black positive image of D max 0.7 and D min 0.02 in the receptor coating and a strong negative image on the PMT paper. This illustrates the well known photomechanical transfer process and can be used to prepare a silver image in polymer E.

EXAMPLES 33–37

These examples illustrate improvements in optical and electrical properties achieved by using the crosslinked binders of this invention in conventional one-layer films.

A polymer solution was made from the following ingredients:

| Ingredient | Amount (gm) |
|---|---|
| polymer A | 0.5 |
| water | 2.62 |
| 2-propanol | 0.8 |
| potassium hydroxide | 0.07 |
| potassium bicarbonate | 0.0013 |
| Acid Violet 520 | 0.0375 |

To this solution was added with stirring 12 grams of a 16.6% silver chloride emulsion containing 10 grams of gelatin per mole of silver chloride, then the corsslinking agent in the amount specified. The dispersion was coated by doctor blade onto an indium tin oxide polyester substrate which had been coated with a 1.8 milligram per square decimeter subbing of polyvinylidene chloride resin, heat set at 170° C. and overcoated with a gelatin layer at 1 mg/dm$^2$. The dried films had 72 mg of silver chloride per square decimeter, with a silver ion to polymer ratio of 4 to 1. The films were exposed on a Berkey-Ascor light source which had a 2 kw photopolymer bulb and tray-processed according to the following procedure: 3 minutes in CUFD developer (E. I. du Pont de Nemours and Co.) at 32.2° C.; 30 sec in DLF fixer (E. I. du Pont de Nemours and Co.); 30 sec in 2% acetic acid stop bath at 25° C.; followed by cold water washing and drying. The optical densities were measured and summarized in Table 14. The crosslinked films developed higher silver densities in the exposed areas and had lower fog in the unexposed areas.

TABLE 14

| Example | Crosslinker | Wt. %[a] | Dmax | Dmin |
|---|---|---|---|---|
| 33 | none | — | 2.54 | 0.20 |
| 34 | 5022 | 4.4 | 2.95 | 0.07 |
| 35 | 5022 | 17.6 | 3.35 | 0.08 |
| 36 | 5044 | 5.2 | 2.84 | 0.07 |

[a]wt. % = weight percent of polymer

The processed films were mounted on an aluminum plate and electrical connection from the conductive indium tin oxide substrate to ground was made with the use of conductive copper tape. The films were equilibrated in a glove box at 25° C. and 24% relative humidity as measured with an Omega hand held hygrometer (Model RH-201). They were then corona charged with a double wire corotron at 8.2 kv. Charging was stopped and the charge allowed to decay. Acceptance voltages in the non-silver polymer areas were determined with the use of an electrostatic surface probe. Surface resistance in the silver image areas was measured with a Fluka 77 Multimeter (John Fluke Mfg. Co., Inc.) between two probes one centimeter apart. The results are summarized in Table 15. The acceptance voltages changed only slightly with the addition of the crosslinking agents, however, the surface resistance was significantly reduced.

TABLE 15

| Example | Crosslinker | Wt. % | Acceptance Voltage[a] 2 sec. | 15 sec. | 60 sec. | Surface Resistance[b] |
|---|---|---|---|---|---|---|
| 33 | none | — | 106 | 72 | 55 | 80 |
| 34 | 5022 | 4.4 | 100 | 69 | 51 | 56 |
| 35 | 5022 | 17.6 | 85 | 66 | 47 | 45 |
| 36 | 5022 | 19.8 | 109 | 53 | 46 | 40 |
| 37 | 5044 | 5.2 | 94 | 65 | 48 | 35 |

[a]in volts per micron
[b]in ohms

EXAMPLES 38–46

These examples illustrate the improved optical and electrical properties of diffusion transfer films using the crosslinked binders of the invention.

A polymer solution was prepared from the following ingredients:

| Ingredient | Amount (gm) |
|---|---|
| polymer A | 80 |
| water | 1749 |
| 2-propanol | 100 |
| aqueous ammonia (29%) | 7.2 |

To this solution was added in two simultaneous streams and with rapid stirring the following solutions over 2–3 min: 333.4 gm of a 1% solution of zinc sulfate containing 80 gm of 2-propanol; and 68.4 gm of a 5% solution of sodium sulfide. Three gm of a 40% aqueous tetraethylammonium hydroxide solution was then added to the mixture. To this was added 8 grams of an antihalation dye, tartrazine (Acid yellow 23). To a portion of this stock solution was added the specified quantities of crosslinking agent. The solutions were coated onto an indium tin oxide sputtered polyester substrate on a bar coater. The dried receptor films were cured at high contrast emulsion of $AgCl_{0.8}Br_{0.195}I_{0.005}$ (average grain volume=0.01 cubic microns) dispersed 2:1 in gelatin but without a hardener. Coating weights of the receptors were 8.8 to 9.5 mg/dm$^2$ and those of the emulsion layer were 105 to 110 mg/dm$^2$.

The multilayer coatings were imagewise exposed with light and processed in a Du Pont UPP Cronaflow® Processor according to the following steps:

(1) development at 27° C. using the developer solution shown below;

| Ingredient | Amount (gm) |
|---|---|
| hydroquinone | 15 |
| Dimezone S | 1.5 |
| sodium sulfite | 60 |
| sodium carbonate | 75 |
| potassium bromide | 1 |
| ethylenediaminetetraacetic acid, disodium salt | 1 |
| sodium thiosulfate | 25 |
| methylaminoethanol | 25 |
| water to make 1 L | |

(2) acid stop using a stop solution containing 2.5% acetic acid and 12.5% of sodium sulfate;
(3) water rinse at 40° C. and 60 psi at the coating surface;
(4) drying at 60° C.

The optical density and the surface resistance of the developed silver images and the acceptance voltage of the non-imaged polymer areas were eveluated as described in examples 33-37. The results are shown in Table 16 (Dmax normalized to 10 mg/dm$^2$ coating weight).

TABLE 16

| Example | Cross-linker | Wt. % | Dmax | Acceptance Voltage[a] 2 sec. | 15 sec. | 60 sec. | Surface Resistance[b] |
|---|---|---|---|---|---|---|---|
| 38 | none | — | 2.89 | 85 | 53 | 44 | 1300 |
| 39 | 5022 | 4 | 4.38 | 82 | 50 | 43 | 20 |
| 40 | 5022 | 6 | 4.59 | 78 | 49 | 41 | 25 |
| 41 | 5022 | 8 | 4.32 | 65 | 37 | 31 | 10 |
| 42 | 5022 + FSNC | 8 | 4.40 | 80 | 44 | 36 | 7 |
| 43 | 5044 | 6 | 3.24 | 79 | 47 | 38 | 70 |
| 44 | PT-810 | 2 | 4.15 | 83 | 47 | 40 | 600 |
| 45 | PT-810 | 3 | 4.14 | 87 | 56 | 47 | 50 |
| 46 | PT-810 | 5 | 3.28 | 63 | 38 | 33 | 5 |

[a]in volts per micron
[b]in ohms
[c]surfactant Zonyl FSN

EXAMPLES 47-68

Examples 38-46 were repeated with the addition of 0.8 g of a combinations. The results are given in Table 17.

TABLE 17

| Example | Polymer | Cross-linker | Wt. % | Dmax | Acceptance Voltage[a] 2 sec | 15 sec | 60 sec |
|---|---|---|---|---|---|---|---|
| 47 | A | none | — | 3.48 | 63 | 40 | 26 |
| 48 | A | MK-107 | 8 | 3.72 | 77 | 45 | 34 |
| 49 | A | WC-68 | 6 | 3.35 | 67 | 39 | 25 |
| 50 | A | WC-67 | 8 | 4.82 | 75 | 41 | 27 |
| 51 | A | XAMA-7 | 3 | 4.19 | 80 | 52 | 37 |
| 52 | B | none | — | 3.98 | 75 | 50 | 36 |
| 53 | B | 5022 | 8 | 4.41 | 71 | 47 | 31 |
| 54 | B | MY-721 | 3 | 4.80 | 67 | 47 | 33 |
| 55 | B | XUGY-281 | 5 | 3.71 | 78 | 52 | 36 |
| 56 | B | XAMA-7 | 3 | 4.30 | 64 | 43 | 30 |
| 57 | D | none | — | 3.80 | 50 | 29 | 19 |
| 58 | D | 5022 | 8 | 3.75 | 60 | 37 | 26 |
| 59 | D | 0500 | 3 | 4.11 | 55 | 32 | 23 |
| 60 | D | XAMA-7 | 3 | 4.69 | 61 | 39 | 28 |
| 61 | K | none | — | 2.52 | 43 | 21 | 12 |
| 62 | K | 5022 | 4 | 3.24 | 53 | 27 | 14 |
| 63 | K | 0500 | 5 | 2.85 | 57 | 29 | 17 |
| 64 | L | none | — | 2.69 | 37 | 17 | 8 |
| 65 | L | MY-721 | 3 | 3.94 | 32 | 12 | 4 |
| 66 | L | HDU | 3 | 2.87 | 40 | 17 | 7 |
| 67 | L | MDEI | 3 | 3.69 | 44 | 17 | 7 |
| 68 | L | XAMA-7 | 3 | 2.87 | 33 | 13 | 5 |

[a]in volts per micron

EXAMPLE 69

This example illustrates the preparation of a diffusion transfer film and the use of such films to procude four-color surprints for high resolution color proofing applications.

A solution was made of the following ingredients:

| Ingredient | Amount (gm) |
|---|---|
| water | 43473 |
| 2-propanol | 3600 |
| ammonium hydroxide (29%) | 756 |

To this was added with intense stirring 3600 gm of Polymer A and the mixture was stirred at 25° C. until the polymer dissolved. The temperature was raised to 50° C. for several hours to remove excess ammonia. To the polymer solution were added in two simultaneous streams with rapid stirring 15,553 gm of a 1% aqueous solution of zinc sulfate and 3072 gm of a 5% aqueous solution of sodium sulfide. After making the zinc sulfide development nuclei, 3600 gm of a 10% aqueous solution of tartrazine dye, 396 gm of Epi-Rez ® 5022, 360 gm of a 20% aqueous solution of tetraethylammonium to 4% of polymer by the addition of water. The solution was coated onto an indium tin oxide polyester base on a bar coater at 80 ft/min and dried at 85° C. The receptor film thus prepared was overcoated with the silver halide emulsion described in Examples 19-27 on a bar coater at 80 ft/min. The final receptor layer coating weight was 10.1 mg/dm$^2$; that of the emulsion layer was 128 mg/dm$^2$. An antihalation dye layer was also coated on the back side of the polyester base. Color separation electrostatic printing masters were prepared from the film using a set of color separation negatives for contact exposure and automatic processing as described in Examples 38-59.

The masters were tones with liquid processed color toners using a flat-bed toning device at 22° C. and 40% relative humidity. The doublewire corotron was biased at 4 to 6 kV and the development electrode was maintained at ground potential.

The toner images showed 2-98% halftone dots/150 lines per inch halftone screen. They were transferred to offset enamel paper in sequence and in registration to give four-color surprint proofs. First, the yellow master was charged, developed and metered. The transfer station was positioned and the toned yellow image transferred onto the paper. After the yellow transfer was completed, the magenta master was corona charged, developed and metered, and the magenta image transferred, in registry, on top of the yellow image transferred, in registry, on top of the yellow image. Afterwards, the cyan master was corona charged, developed, and metered, and the cyan image was transferred on top of the two previous images. Finally the black master was corona charged, developed, metered, and the toned black image transferred, in registry, on top of the three previously transferred images. After the procedure was completed, the paper was carefully removed from the transfer station and the image fused by 15 seconds at 100° C. The reflection optical densities of the four colors were: yellow, 0.83; magenta, 1.36; cyan, 1.18; and black, 1.42.

EXAMPLES 70-84

These examples illustrate the use of mixed binder systems with crosslinking agents in diffusion tranfer films.

The procedure in examples 47-69 was repeated using Polymer A with and without a co-binder. The co-binders used were low molecular weight polymers that were half esters of styrene/maleic anhydride copolymers (SMA 1440 and 2625, Arco Chemical Corp.). The co-binders alone were poor film formers, but became useful co-binders when crosslinked with Polymer A. Coating weights of the receptors were 9–10 mg/dm$^2$ and those of the emulsion layer were 105–110 mg/dm$^2$. The results are summarized in Table 18. The crosslinked films showed higher Dmax and acceptance voltages than the uncrosslinked films particularly at higher relative humidity.

TABLE 18

| Example | Crosslinker | Wt. % | Dmax | Relative Humidity 50% | Relative Humidity 65% | Acceptance Voltage 2 sec | Acceptance Voltage 15 sec | Acceptance Voltage 60 sec |
|---|---|---|---|---|---|---|---|---|
| | | | 100 Polymer I | | | | | |
| 70 | None | — | 3.74 | X | — | 59 | 34 | 23 |
| 70 | | | | | X | 22 | 11 | 8 |
| 71 | 5022 | 4 | 3.95 | X | — | 69 | 42 | 29 |
| 71 | | | | | X | 46 | 27 | 18 |
| 72 | XAMA-7 | 3 | 3.96 | X | — | 69 | 42 | 30 |
| 72 | | | | — | X | 45 | 25 | 16 |
| 73 | HDU | 3 | 3.87 | X | — | 66 | 39 | 26 |
| 74 | MDEI | 3 | 3.72 | X | — | 61 | 37 | 26 |
| 74 | | | | — | X | 75 | 28 | 18 |
| | | | Polymer I and 20% SMA 1440 | | | | | |
| 75 | None | — | 4.06 | X | — | 70 | 40 | 26 |
| 75 | | | | — | X | 48 | 25 | 17 |
| 76 | 5022 | 4 | 4.22 | X | — | 65 | 37 | 26 |
| 76 | | | | — | X | 49 | 26 | 17 |
| 77 | XAMA-7 | 3 | 5.22 | X | — | 66 | 37 | 24 |
| 77 | | | | — | X | 47 | 27 | 16 |
| 78 | HDU | 3 | 5.06 | X | — | 59 | 34 | 23 |
| 78 | | | | — | X | 46 | 25 | 16 |
| 79 | MDEI | 3 | 4.47 | X | — | 62 | 38 | 25 |
| 79 | | | | — | X | 49 | 27 | 17 |
| | | | 80% Polymer I and 20% SMA 2625 | | | | | |
| 80 | None | — | 3.88 | X | — | 70 | 37 | 24 |
| 80 | | | | — | X | 48 | 26 | 16 |
| 81 | 5022 | 4 | 5.02 | X | — | 59 | 38 | 25 |
| 81 | | | | — | X | 49 | 28 | 18 |
| 82 | XAMA-7 | 3 | 5.16 | X | — | 66 | 38 | 25 |
| 82 | | | | — | X | 51 | 28 | 17 |
| 83 | HDU | 3 | 4.40 | X | — | 76 | 43 | 29 |
| 83 | | | | — | X | 53 | 32 | 20 |
| 84 | MDEI | 3 | 4.24 | X | — | 73 | 43 | 28 |
| 84 | | | | — | X | 56 | 33 | 21 |

We claim:

1. A photosensitive element suited for aqueous processing consisting essentially of a silver halide photographic salt dispersed in a synthetic insulating polymeric binder that is swellable in aqueous solutions having a pH higher than approximately 8½, said binder being prepared by crosslinking:

(a) a copolymer of an aromatic monomer and an unsaturated carboxylic acid, said copolymer having ionizing carboxylic acid groups, with, (b) approximately 1 to 30% by weight, based on said copolymer weight, of a polyfunctional epoxide or aziridine crosslinking agent, said element having an insulation value such that it will support an apparent macroscopic electric field of at least approximately five (5) volts/micron as measured 2 seconds following full charging of its surface that has been allowed to equilibrate at 50% relative humidity at 20° C. for 1 hour.

2. The element of claim 1 wherein the binder is swellable in aqueous solutions having a pH in the range of approximately 9 to 14 and has an insulation value of at least approximately 30 volts/micron.

3. The element of claim 1 wherein the copolymer has an acid number of approximately 70 to 160.

4. The element of claim 1 wherein the binder is a copolymer of an aromatic monomer and acrylic or methacrylic acid.

5. The element of claim 1 wherein the crosslinking agent is a polyfunctional epoxide.

6. The element of claim 5 wherein the polyfunctional epoxide is selected from the group consisting of 1,4-butanediol diglycidyl ether; ethoxylated trimethylolpropane triglycidyl ether; (3,4-epoxycyclohexyl) methyl 3,4-epoxy-cyclohexane carboxylate; diglycidyl ethers of bis-phenol F and bis-phenol A; methylene dianiline derived epoxy resins; p-aminophenol derived epoxy resins; and triazine based epoxy resins.

7. The element of claim 6 wherein the binder is swellable in aqueous solutions having a pH in the range of approximately 9 to 14 and has an insulation value of at least approximately 30 volts/micron.

8. The element of claim 7 wherein the copolymer has an acid number of approximately 70 to 160.

9. The element of claim 8 wherein the copolymer is a copolymer of an aromatic monomer and acrylic or methacrylic acid.

10. The element of claim 1 wherein the crosslinking agent is a polyfunctional aziridine.

11. The element of claim 10 wherein the aziridine is selected from the group consisting of pentaerythritol tri-beta-aziridinylpropionate; N,N'-hexamethylene-1,6-bis(1-aziridinecarboxyamide); and N,N'-diphenylmethane-4,4'-bis(1-aziridinecarboxyamide).

12. The element of claim 11 wherein the binder is swellable in aqueous solutions having a pH in the range of approximately 9 to 14 and has an insulation value of at least approximately 30 volts/micron.

13. The element of claim 12 wherein the copolymer has an acid number of approximately 70 to 160.

14. In an electrostatic printer master suited for aqueous processing comprising a conductive substrate that bears a silver halide photographic salt dispersed in an insulating binder, the improvement wherein the binder is prepard by crosslinking:

(a) a copolymer of an aromatic monomer and an unsaturated carboxylic acid, said copolymer having ionizing carboxylic acid groups, with, (b) approximately 1 to 30% by weight, based on said copolymer weight, of a polyfunctional epoxide or aziridine crosslinking agent;

said binder being swellable in aqueous solutions having a pH higher than approximately 8½ and having an insulation value such that it will support an apparent macroscopic electric field of at least approximately five (5) volts/micron as measured 2 seconds following full charging of its surface that has been allowed to equilibrate at 50% relative humidity at 20° C. for 1 hour.

15. The master of claim 14 wherein the binder is swellable in aqueous solutions having a pH in the range of approximately 9 to 14 and has an insulation value of at least approximately 30 volts/micron.

16. The master of claim 14 wherein the binder has an acid number of approximately 70 to 160.

17. The master of claim 14 wherein the binder is a copolymer of an aromatic monomer and acrylic or methacrylic acid.

18. The master of claim 14 wherein the crosslinking agent is a polyfunctional epoxide.

19. The master of claim 18 wherein the polyfunctional epoxide is selected from the group consisting of 1,4-butanediol, digylcidyl ether; ethoxylated trimethylolpropane triglycidyl ether; 3,4-epoxy-6-methylcyclohexylmethyl; 3,4-epoxy-6-methylcyclohexane carboxylate; the diglycidyl ethers of bis-phenol F and bisphenol A; methylene dianiline derived epoxy resins; p-aminophenol derived epoxy resins; and triazine based epoxy resins.

20. The master of claim 19 wherein the binder is swellable in aqueous solutions having a pH in the range of approximately 9 to 14 and has an insulation value of at least approximately 30 volts/micron.

21. The master of claim 20 wherein the binder has an acid number of approximately 70 to 160.

22. The master of claim 21 wherein the copolymer is a copolymer of an aromatic monomer and acrylic or methacrylic acid.

23. The master of claim 14 wherein the crosslinking agent is a polyfunctional aziridine.

24. The master of claim 23 wherein the aziridine is selected from the group consisting of pentaerythritol tribeta-aziridinylpropionate; N,N'-hexamethylene-1,6-bis(1-aziridinecarboxyamide); and N,N'-diphenylmethane-4,4'-bis(1-aziridinecarboxyamide).

25. The master of claim 24 wherein the binder is swellable in aqueous solutions having a pH in the range of approximately 9 to 14 and has an insulation value of at least approximately 30 volts/micron.

26. The master of claim 25 wherein the binder has an acid number of approximately 70 to 160.

27. The master of claim 26 wherein the copolymer is a copolymer of an aromatic monomer and acrylic or methacrylic acid.

28. In an electrostatic printer master suited for aqueous processing comprising a conductive substrate that bears a silver halide photographic salt dispersed in an insulating binder, the improvement wherein the binder is prepared by crosslinking:

(a) a copolymer of an unsaturated carboxylic acid having an acid number of approximately 70 to 160 with, (b) approximately 1 to 30% by weight, based on said copolymer weight, of a polyfunctional epoxide or aziroidine crosslinking agent;

said binder being swellable in aqueous solutions having a pH higher than approximately 8½ and having an insulation value such that it will support an apparent macroscopic electric field of at least approximately five (5) volts/micron as measured 2 seconds following full charging of its surface that has been allowed to equilibrate at 50% relative humidity at 20° C. for 1 hour.

29. The master of claim 28 wherein the binder is swellable in aqueous solutions having a pH in the range of approximately 9 to 14 and has an insulation value of at least approximately 30 volts/micron.

30. The master of claim 28 wherein the binder is a copolymer of an aromatic monomer and acrylic or methacrylic acid.

31. The master of claim 28 wherein the crosslinking agent is a polyfunctional epoxide.

32. The master of claim 31 wherein the polyfunctional epoxide is selected from the group consisting of 1,4-butanediol diglycidyl ether; ethoxylated trimethylolpropane trigylcidyl ether; 3,4-epoxy-6-methylcyclohexylmethyl; 3,4-epoxy-6-methylcyclohexane carboxylate; the diglycidyl ethers of bis-phenol F and bisphenol A; methylene dianiline derived epoxy resins; p-aminophenol derived epoxy resins; and triazine based epoxy resins.

33. The master of claim 32 wherein the binder is swellable in aqueous solutions having a pH in the range of approximately 9 to 14 and has an insulation value of at least approximately 30 volts/micron.

34. The master of claim 33 wherein the copolymer is a copolymer of an aromatic monomer and acrylic or methacrylic acid.

35. The master of claim 28 wherein the crosslinking agent is a polyfunctional aziridine.

36. The master of claim 35 wherein the aziridine is selected from the group consisting of pentaerythritol tribeta-aziridinylpropionate; N,N'-hexamethylene-1,6-bis(1-aziridinecarboxyamide); and N,N'-diphenylmethane-4,4'-bis(1-aziridinecarboxyamide).

37. The master of claim 36 wherein the binder is swellable in aqueous solutions having a pH in the range of approximately 9 to 14 and has an insulation value of at least approximately 30 volts/micron.

38. The master of claim 37 wherein the copolymer is a copolymer of an aromatic monomer and acrylic or methacrylic acid.

39. The element of claim 13 wherein the copolymer is a copolymer of an aromatic monomer and acrylic or methacrylic acid.

* * * * *